US009984669B2

(12) United States Patent
Toyama et al.

(10) Patent No.: US 9,984,669 B2
(45) Date of Patent: May 29, 2018

(54) REED FOR ELECTRONIC MUSICAL INSTRUMENT, AND ELECTRONIC MUSICAL INSTRUMENT

(71) Applicant: CASIO COMPUTER CO., LTD., Tokyo (JP)

(72) Inventors: Chihiro Toyama, Tokyo (JP); Kazutaka Kasuga, Tokyo (JP); Ryutaro Hayashi, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days. days.

(21) Appl. No.: 15/692,249

(22) Filed: Aug. 31, 2017

(65) Prior Publication Data

US 2018/0075831 A1 Mar. 15, 2018

(30) Foreign Application Priority Data

Sep. 15, 2016 (JP) ..... 2016-180061

(51) Int. Cl.
*G10H 3/16* (2006.01)
*G10H 1/06* (2006.01)

(52) U.S. Cl.
CPC ..... *G10H 3/16* (2013.01); *G10H 1/06* (2013.01); *G10H 2220/361* (2013.01); *G10H 2230/205* (2013.01)

(58) Field of Classification Search
CPC ..... G10H 3/16
USPC ..... 84/732, 729
See application file for complete search history.

(56) References Cited

U.S. PATENT DOCUMENTS 2,138,500 A * 11/1938 Miessner ..... G10H 3/16 84/283
2,383,553 A * 8/1945 Johnson ..... H04R 1/46 84/383 R
2,462,531 A * 2/1949 Minshall ..... G10H 3/16 361/283.1
2,494,390 A * 1/1950 Johnson ..... G10H 3/16 84/383 R
3,558,795 A * 1/1971 Barcus ..... G10D 9/00 84/730
4,545,277 A * 10/1985 Strnad ..... G10H 3/16 84/377
6,538,189 B1 * 3/2003 Ethington ..... G10H 1/34 84/615

(Continued)

FOREIGN PATENT DOCUMENTS

DE 3839230 A1 * 5/1990 ..... G10H 3/143
JP H5-46170 A 2/1993

(Continued)

*Primary Examiner* — David Warren
(74) *Attorney, Agent, or Firm* — Chen Yoshimura LLP

(57) ABSTRACT

The present invention provides a reed for an electronic musical instrument and an electronic musical instrument in which determination of lip position is not susceptible to the influence of noise and the like. In one embodiment of the present invention, an electronic musical instrument is provided with a reed and a plurality of sensor electrodes in the reed, arranged next to one another from a tip side of the reed towards a base side of the reed, each of the sensor electrodes having a center portion projecting towards the tip side of the reed. The lip position of the performer is determined in accordance with the output from the plurality of sensors.

15 Claims, 13 Drawing Sheets

(56) References Cited

U.S. PATENT DOCUMENTS

| | | | | |
|---|---|---|---|---|
| 7,727,044 | B1 * | 6/2010 | Johnson | A01M 31/004 446/177 |
| 7,829,780 | B2 * | 11/2010 | Onozawa | G10D 7/00 84/385 R |
| 9,653,057 | B2 * | 5/2017 | Harada | G10H 1/46 |

FOREIGN PATENT DOCUMENTS

| | | | |
|---|---|---|---|
| JP | H7-72853 | A | 3/1995 |
| JP | 2506719 | Y2 | 8/1996 |

* cited by examiner

REED FOR ELECTRONIC MUSICAL INSTRUMENT, AND ELECTRONIC MUSICAL INSTRUMENT

BACKGROUND OF THE INVENTION

Field of the Invention

The present invention relates to a reed for an electronic musical instrument and an electronic musical instrument.

Description of Related Art

In acoustic wind instruments (woodwind instruments that use a reed such as saxophone or clarinet, for example), altering the position and pressure of the lips and tongue in contact with the reed alters tone to produce richly expressive music.

Patent Document 1 discloses an electronic musical instrument that outputs electronically synthesized tones.

This electronic musical instrument controls tone by detecting the position of the lip and tongue using a plurality of pressure-sensitive lip sensors (pressure sensors) arranged on a reed.

Patent Document 1: Japanese Patent Application Laid-Open Publication No. H7-72853

As described above, the electronic musical instrument provided with a reed has a plurality of sensors that detect the state of lip contact to determine the position and the like of the lip on the reed.

However, due to the effect of noise and the like, an output value is sometimes outputted from a sensor that is not in contact with the lip, and it is therefore desirable that determination of lip position on a reed for an electronic musical instrument is not susceptible to the aforementioned influence of noise and the like.

The present invention was made in view of the above and aims at providing a reed for an electronic musical instrument and an electronic musical instrument in which determination of lip position is not susceptible to the influence of noise and the like. Accordingly, the present invention is directed to a scheme that substantially obviates one or more of the problems due to limitations and disadvantages of the related art.

SUMMARY OF THE INVENTION

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a reed for an electronic musical instrument, including: a substrate having a tip side and a base side; and a plurality of sensor electrodes on the substrate, arranged next to one another from the tip side towards the base side, each of the plurality of sensor electrodes having a center part projecting towards the tip side of the substrate.

In another aspect, the present disclosure provides an electronic musical instrument, including: a substrate having a tip side and a base side; a plurality of sensors on the substrate, arranged next to one another from the tip side towards the base side, the plurality of sensors respectively having sensor electrodes, each of the sensor electrodes having a center part projecting towards the tip side of the substrate; at least one or more operating units to receive operations by a performer; a processor configured to execute the following: a determination process of determining a lip position of the performer in accordance with output from the plurality of sensors; and a control process causing the electronic musical instrument to emit a musical sound that corresponds to the lip position determined by the determination process and an operation of the at least one or more operating units.

It is to be understood that both the foregoing general description and the following detailed description are exemplary and explanatory, and are intended to provide further explanation of the invention as claimed.

BRIEF DESCRIPTION OF THE DRAWINGS

A deeper understanding of the present application can be achieved when the detailed description below is combined with the drawings.

FIG. 3A is a cross-sectional view of the mouthpiece, and FIG. 3B is a bottom view of the mouthpiece.

FIG. 5A shows a bottom view of a reed and sensor output values when contact is made at lip contact region C1, FIG. 5B shows a bottom view of a reed and sensor output values when contact is made at lip contact region C2, and FIG. 5C shows a bottom view of a reed and sensor output values when contact is made at lip contact region C2 and tongue contact region C3.

FIG. 7A shows rectangular sensors, FIG. 7B shows M-shaped sensors, FIG. 7C shows W-shaped sensors, FIG. 7D shows inverted V-shaped sensors, and FIG. 7E shows V-shaped sensors.

FIG. 10A shows a case for rectangular sensors, and FIG. 10B shows t=a case for V-shaped sensors.

FIG. 12A shows a case when the angle of the V-shaped sensor at the tip side is small, and FIG. 12B shows a case when the angle of the V-shaped sensor at the tip side is large.

DETAILED DESCRIPTION OF EMBODIMENTS

First, the basic details of an electronic musical instrument 100 containing a reed for an electronic musical instrument (below also referred to as "reed 11") used in an embodiment of the present invention will be described below, followed by a detailed description of the reed for the electronic musical instrument (reed 11).

The basic description will use simplified drawings to facilitate understanding of the basic functions and the like of the reed for the electronic musical instrument (reed 11), and will be followed by a description of the reed for the electronic musical instrument (reed 11) with reference to more detailed drawings.

<Electronic Musical Instrument and Reed for Electronic Musical Instrument>

Figure 1A:
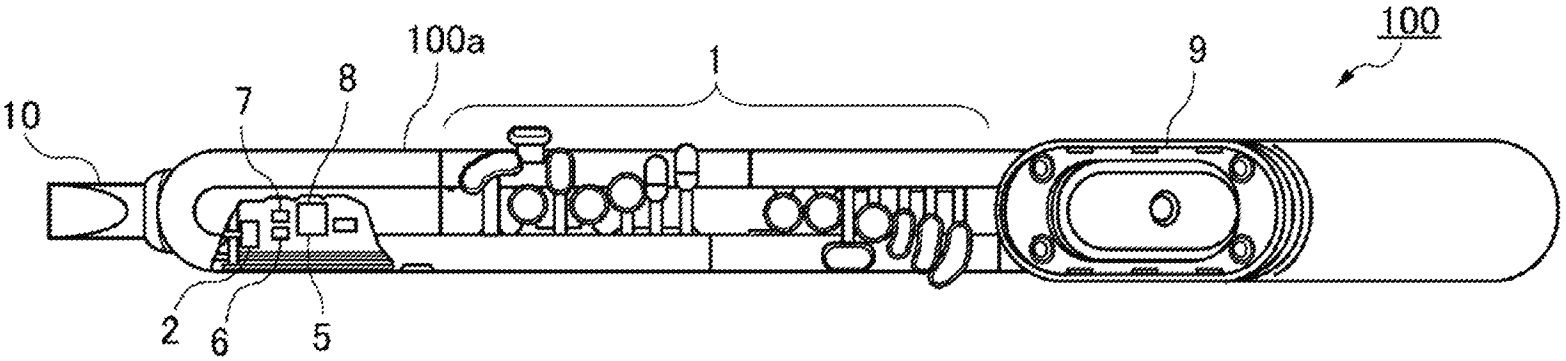
FIG. 1A is a plan view of an electronic musical instrument according to one embodiment of the present invention.
Figure 1B:
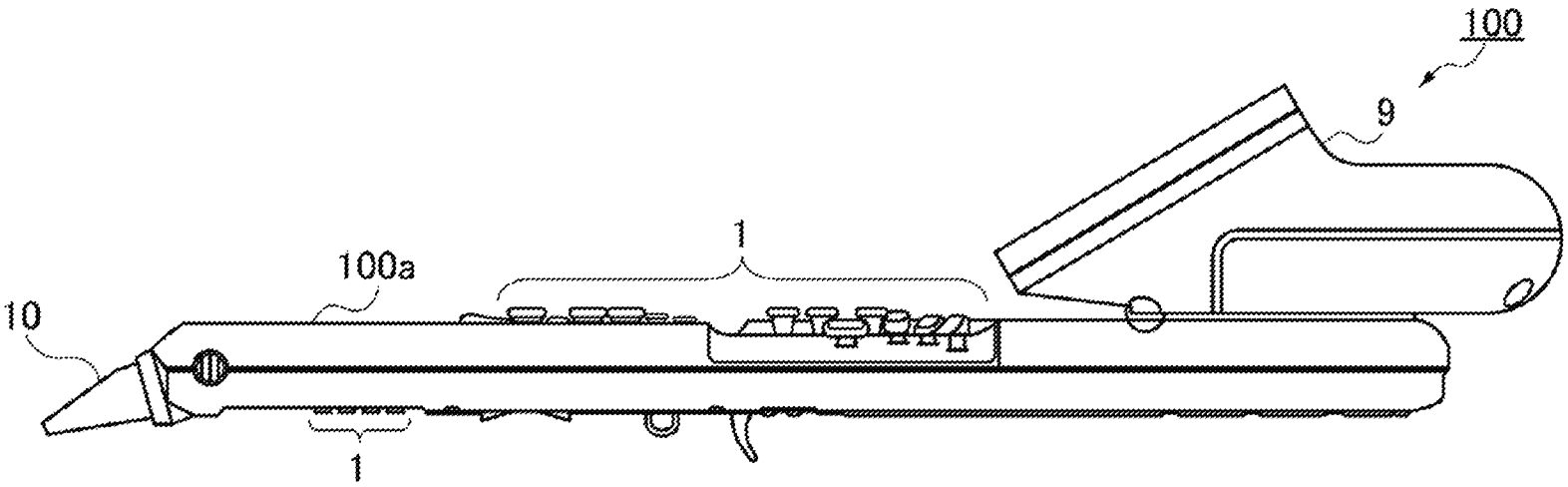
FIG. 1B is a side view of the same electronic musical instrument.

FIG. 1A is a plan view of the electronic musical instrument 100 according to an embodiment of the present invention, and FIG. 1B is a side view of the electronic musical instrument 100.

The electronic musical instrument 100 is an electronic musical instrument for playing music using the techniques of acoustic wind instruments (vibrato, tonguing, growling, for example), specifically woodwind instruments, that use the reed for the electronic musical instrument (reed 11).

In this embodiment, the electronic musical instrument 100 is described using a saxophone as an example, but this embodiment is not limited to this example, and can be applied to electronic musical instrument forms of other wind instruments using a reed, such as a clarinet.

(Electronic Musical Instrument)

As shown in FIGs. 1A and 1B, the electronic musical instrument 100 is provided with a tubular body 100*a*, and an operating unit 1, a sound system 9, and a mouthpiece 10 provided on the tubular body 100*a*. The shape of the electronic musical instrument 100 imitates the shape of a saxophone, which is an acoustic wind instrument.

The tubular body 100*a* is the main casing that imitates the shape of the tubular body of a saxophone. The operating unit 1 is the controls controlled by the fingers of the performer P (user), and includes playing keys for determining pitch, and setting keys for setting functions such as changing the pitch to match the musical key and making fine pitch adjustments.

The mouthpiece 10 is a component controlled by the mouth of the performer P, and is described in detail below.

The sound system 9 is a component that has speakers and so forth, and outputs musical sounds.

In addition, as shown in the partially transparent portion of the electronic musical instrument 100 in FIG. 1A, a substrate provided inside the tubular body 100*a* is provided with a breath pressure sensor 2, a CPU (center processing unit) 5 as a control unit, a ROM (read only memory) 6, a RAM (random access memory) 7, and a sound generator 8.

The breath pressure sensor 2 is a sensor for detecting the pressure of breath (breath pressure) blown into the mouthpiece 10 by the performer P.

The sound generator 8 is a circuit for generating musical sounds.

The CPU 5, ROM 6, and RAM 7 are described below.

Next, the functional configuration of the electronic musical instrument 100 is described with reference to FIG. 2.

Figure 2:
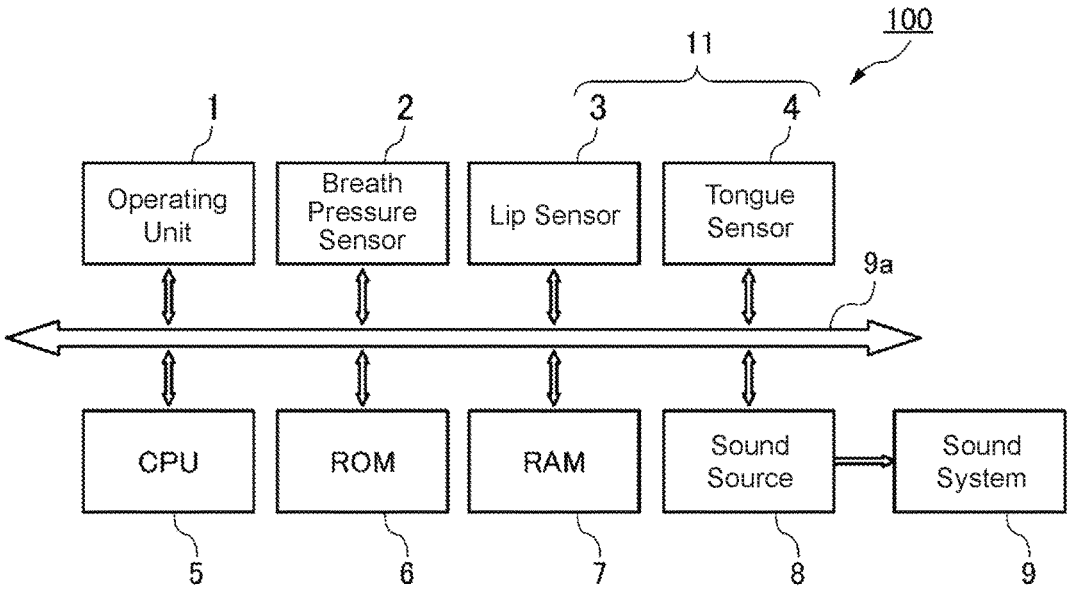
FIG. 2 is a block diagram showing the functional configuration of an electronic musical instrument according to one embodiment of the present invention.

FIG. 2 is a block diagram showing the functional configuration of the electronic musical instrument 100.

As shown in FIG. 2, the electronic musical instrument 100 is provided with an operating unit 1, a breath pressure sensor 2, a lip sensor 3, a tongue sensor 4, a CPU 5, a ROM 6, a RAM 7, a sound generator 8, and a sound system 9.

As described below, the lip sensor 3 and tongue sensor 4 are contained in the reed 11 (see FIGS. 3A and 3B) provided in the mouthpiece 10.

Each of the components of the electronic musical instrument 100 except for the sound system 9 are mutually connected via a bus 9*a*.

The operating unit 1 has various keys such as playing keys and setting keys, as described above, and responds to the operation of the keys by the performer P and outputs this operation information to the CPU 5.

The setting keys configure the functions for setting tone, changing the pitch to suit the musical key, making fine pitch adjustments, and for setting modes preselected from tone, volume, or pitch that are finely adjusted in response to the contact position of the lip L and contact area of the lip L detected by the lip sensor 3.

The breath pressure sensor 2 detects the pressure of breath blown into the mouthpiece 10 by the performer P, and outputs this breath pressure information to the CPU 5.

The lip sensor 3 is a capacitance-type touch sensor that detects contact of the lip L of the performer P and outputs capacitance corresponding to the contact position of the lip L and the contact area of the lip L on the touch sensor to the CPU 5 as lip L detection information.

The lip L contact position (center of gravity) is calculated as described below.

The tongue sensor 4 is a capacitance-type touch sensor that detects the contact state of the tongue of the performer P, and outputs capacitance corresponding to the contact area of the tongue on the touch sensor to the CPU 5 as tongue detection information.

The CPU 5 controls each part of the electronic musical instrument 100.

The CPU 5 reads a specified program from the ROM 6, runs the program in the RAM 7 and executes various processes in cooperation with the expanded program.

More specifically, the CPU 5 instructs the sound generator 8 to generate musical sounds based on control information received from the operating unit 1, breath pressure information received from the breath pressure sensor 2, lip L contact detection information received from the lip sensor 3, and tongue contact detection information received from the tongue sensor 4.

The CPU 5 sets the pitch of the musical sound based on pitch information as control information received from the operating unit 1, sets the volume of the musical sound based on breath pressure information received from the breath pressure sensor 2, finely adjusts one or more of tone, volume, and pitch of the musical sound according to capacitance in response to the contact position of the lip L and the contact area of the lip L based on lip L detection information received from the lip sensor 3, and sets the tone to on/off based on the tongue contact detection information received from the tongue sensor 4, for example.

The ROM 6 is a read-only semiconductor memory that stores various data and various programs.

The RAM 7 is a volatile semiconductor memory that has a work area for temporarily storing data and programs.

The sound generator 8 is a synthesizer that generates musical sounds and outputs musical sound signals to the sound system 9 in accordance with musical sound generation instructions (musical sound control) from the CPU 5 based on control information from the operating unit 1, lip L detection information from the lip sensor 3, and tongue detection information from the tongue sensor 4.

The sound generator 8 has an LPF that filters musical sound signals, but the LPF may be arranged between the sound generator 8 and the sound system 9 or within the sound system 9.

The sound system 9 applies signal amplification and so forth to musical sound signals received from the sound generator 8 and outputs these musical sound signals as musical sounds from an in-built speaker.

(Mouthpiece and Reed)

Figure 3A:
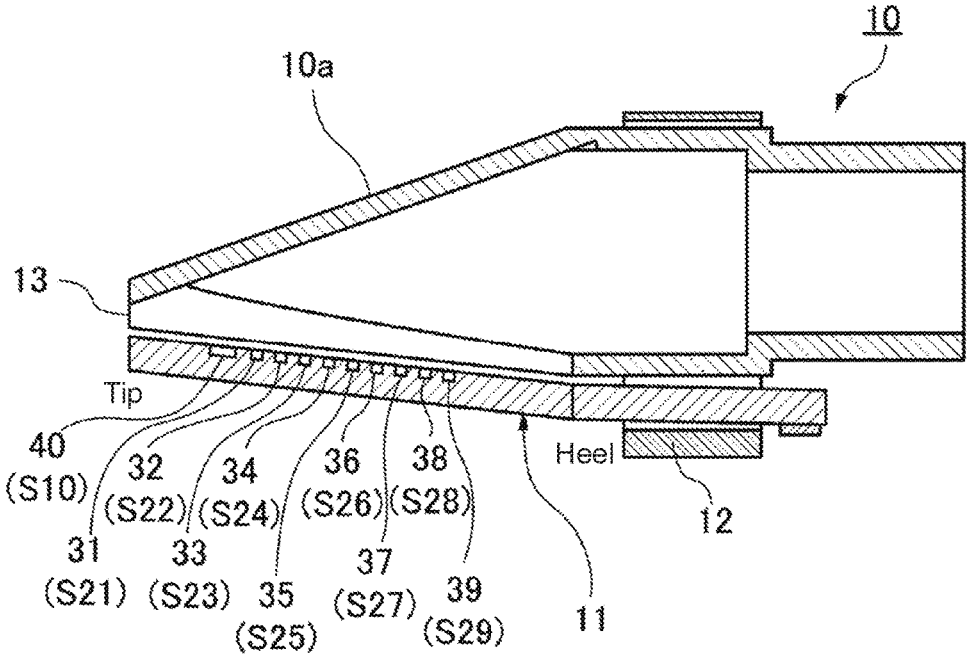
FIGS. 3A and 3B show a mouthpiece according to one embodiment of the present invention.

Next, the basic details of the mouthpiece 10 are described with reference to FIGS. 3A and 3B and FIG. 4. FIG. 3A is a cross-sectional view of the mouthpiece 10, and FIG. 3B is a bottom view of the mouthpiece 10.

In FIG. 3A, the side towards the mouth of the performer P is called the "tip" (tip side) and the side towards the tubular body 100*a* is called the "heel" (base side) as viewed lengthwise along the mouthpiece 10.

Similarly, in the drawings hereinafter, the side towards the mouth of the performer P is called the "tip" and the side towards the tubular body 100*a* is called the "heel."

Figure 3B:
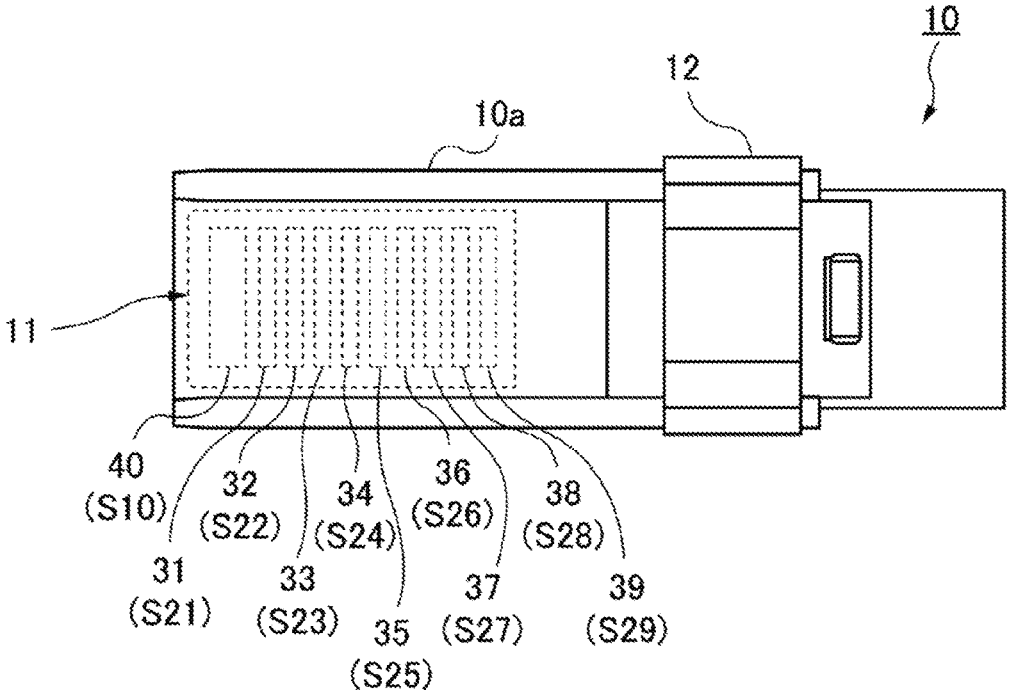

As shown in FIGS. 3A and 3B, the mouthpiece 10 has a mouthpiece body 10*a*, a reed 11, and a metal fitting 12.

The mouthpiece body 10*a* is the main component of the mouthpiece 10, having an opening 13 into which the performer P blows, and is connected to the tubular body 100*a*.

The reed 11 is provided below the mouthpiece body 10*a* in a position corresponding to a reed in an acoustic wind instrument.

The reed 11 is fixed to the mouthpiece body 10*a* by the metal fitting 12.

As shown in FIG. 3B, the reed 11 has a substrate and a plurality of sensors electrodes 40 and 31-39 provided on the substrate.

The plurality of sensor electrodes 40 and 31-39 are arranged in a row from the tip (tip side) to the heel (base side) of the substrate.

The sensor 40 is an electrode of a capacitance-type touch sensor S10 belonging to the tongue sensor 4.

The sensor electrodes 31-39 are electrodes of capacitance-type touch sensors S21-S29 belonging to the lip sensor 3.

The sensors electrodes 31-39 are lined up at substantially equal intervals from the tip side to the heel side of the reed 11 and are of substantially equal width.

In FIG. 3B, the sensors electrodes 31-39 are depicted as rectangular, for convenience, but have a substantially V-shaped outline in this embodiment, as described below.

Figure 4:
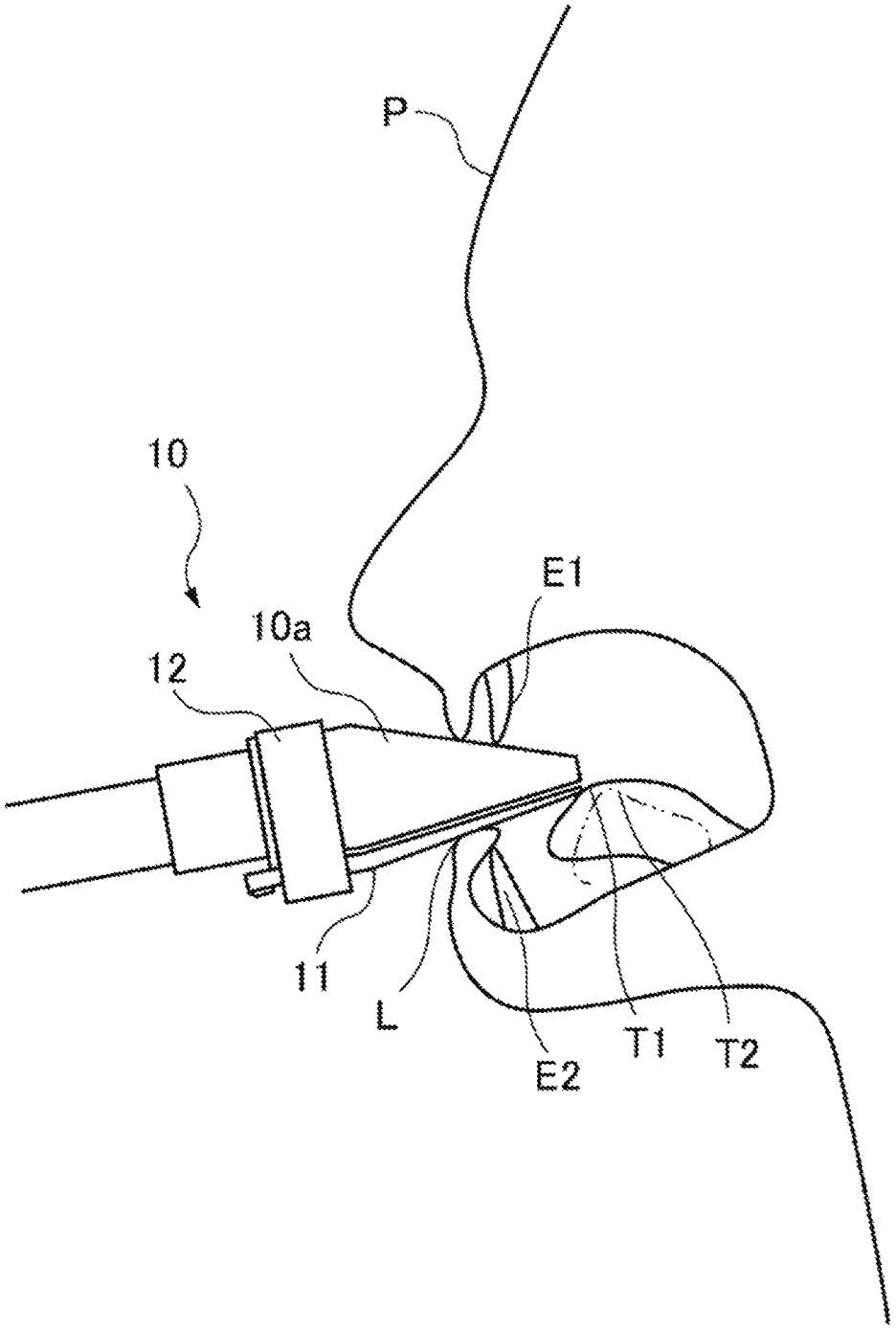
FIG. 4 shows the state of contact between the mouth of a performer and the mouthpiece.

FIG. 4 shows the state of contact between the mouth of the performer P and the mouthpiece 10.

As shown in FIG. 4, when playing the electronic musical instrument 100, the performer P touches the reed 11 with upper front teeth E1 touching the top of the mouthpiece body 10*a* and lower lip L wrapped over lower front teeth E2.

The mouthpiece 10 is thereby retained by the upper front teeth E1 and the lip L.

During playing, the tongue inside the mouth adopts either the state of the tongue T1 touching the reed 11 (solid line) or the tongue T2 not touching the reed 11 (broken line).

The touch sensors S10 and S21-29 sense the contact state of the lip L and tongue (tongue T1: contact, or tongue T2: no contact) on the sensor electrodes 40 and 31-39, and output the detection information to the CPU 5.

As described in detail below, the CPU 5 calculates the contact position of the lip L on the reed 11 in response to the detection information outputted from the touch sensors S21-S29.

Similarly, the CPU 5 determines whether the tongue is in contact based on the detection information outputted from the touch sensor S10.

(Output Characteristics of Lip Sensor and Tongue Sensor)

The output characteristics of the lip sensor 3 and tongue sensor 4 are described with reference to FIGS. 5A to 5C.

Figure 5C:
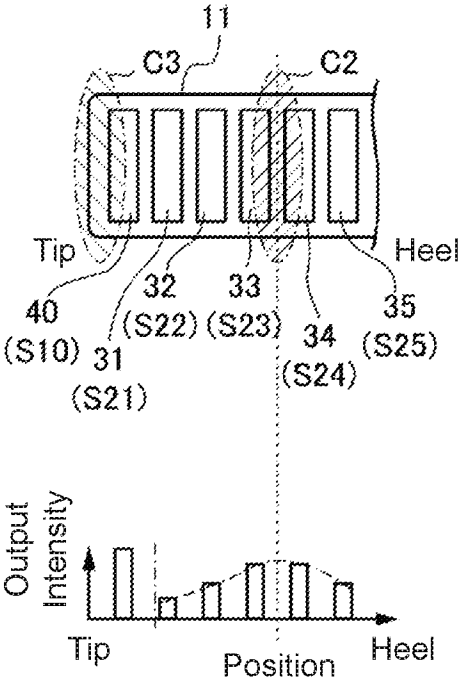
FIGS. 5A to 5C illustrate the output characteristics of a lip sensor and tongue sensor according to one embodiment of the present invention.
Figure 5B:
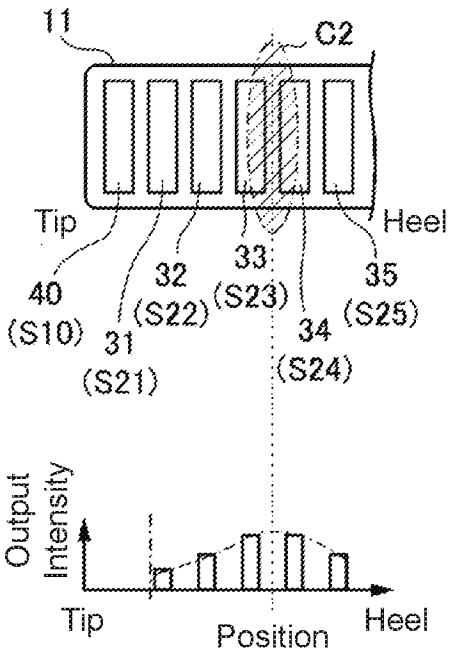
Figure 5A:
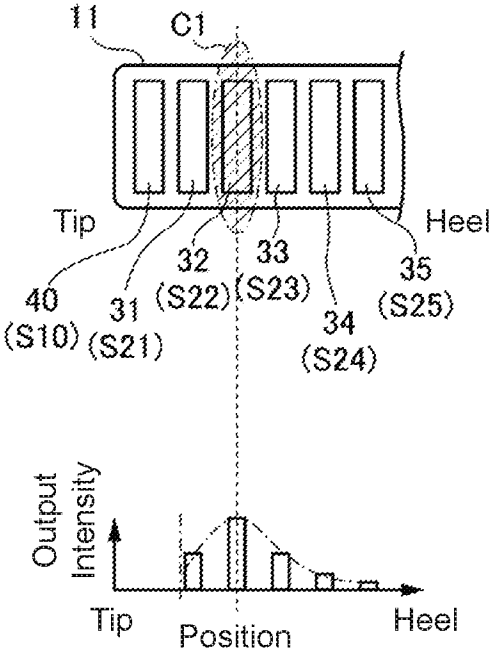

FIG. 5A shows a bottom view of the reed 11 and sensor output values when contact is made at lip contact region C1, FIG. 5B shows a bottom view of the reed 11 and sensor output values when contact is made at lip contact region C2, and FIG. 5C shows a bottom view of the reed 11 and sensor output values when contact is made at lip contact region C2 and tongue contact region C3.

The graphs in FIGS. 5A-5C are bar graphs showing sensor output, with the horizontal axis showing position on the reed 11 and the vertical axis showing the output intensity (output voltage) of the touch sensors S10 and S21-25 corresponding to the respective sensors.

However, in FIGS. 5A-5C, the sensor electrodes 36-39 corresponding to the touch sensors S26-29 and the corresponding output intensities from the sensor electrodes 36-39 are omitted for convenience.

As shown in FIG. 5A, when the lip L of the performer P is brought most strongly into contact with the lip contact region C1, the output intensity distribution is highest at the touch sensor S22 in the sensor electrode 32 corresponding to the lip contact region C1.

In addition, as shown in FIG. 5B, when the lip L of the performer P is brought most strongly into contact with the lip contact region C2, the output intensity distribution is highest at the touch sensors S23 and S24 in the sensor electrodes 33 and 34 corresponding to the lip contact region C2.

However, in FIG. 5A and FIG. 5B, no output intensity is obtained from the touch sensor S10 in the sensor electrode 40.

Using capacitance-type touch sensors in this way, a response is obtained not only at the sensors overlapping the lip contact regions C1 and C2 but also at the sensors adjacent to these overlapping sensors.

Therefore, as described below, the CPU 5 is configured to extract the lip contact position as the center of contact, or rather the center of gravity, in the lip contact region.

In addition, as shown in FIG. 5C, when the tongue is brought into contact with the tongue contact region C3 while the lip L of the performer P is touching the lip contact region C2, not only the distribution of output values is highest at the touch sensors S23 and S24 corresponding to the sensor electrodes 33 and 34 overlapping the lip contact region C2, but also a large output value is obtained at the touch sensor S10 corresponding to the sensor electrode 40 overlapping the tongue contact region C3.

In this way, the CPU 5 calculates the contact position (center of gravity) of the lip L based on the output values of the touch sensors S21-S29 corresponding to the sensors in contact with the lip L from among the sensor electrodes 31-39 (the calculation method being described below), and can also determine whether the tongue is touching based on whether the output value from the touch sensor S10 as detection information from the tongue sensor 4 is above a prescribed threshold.

(Calculation of Center of Gravity of Lip L)

The center of gravity is calculated based on the respective output values from the plurality of sensor electrodes 31-39 and identifiers (position numbers) of the plurality of sensor electrodes 31-39, and a specific method of calculating the center of gravity of the lip L is described below with reference to FIG. 6.

Figure 6:
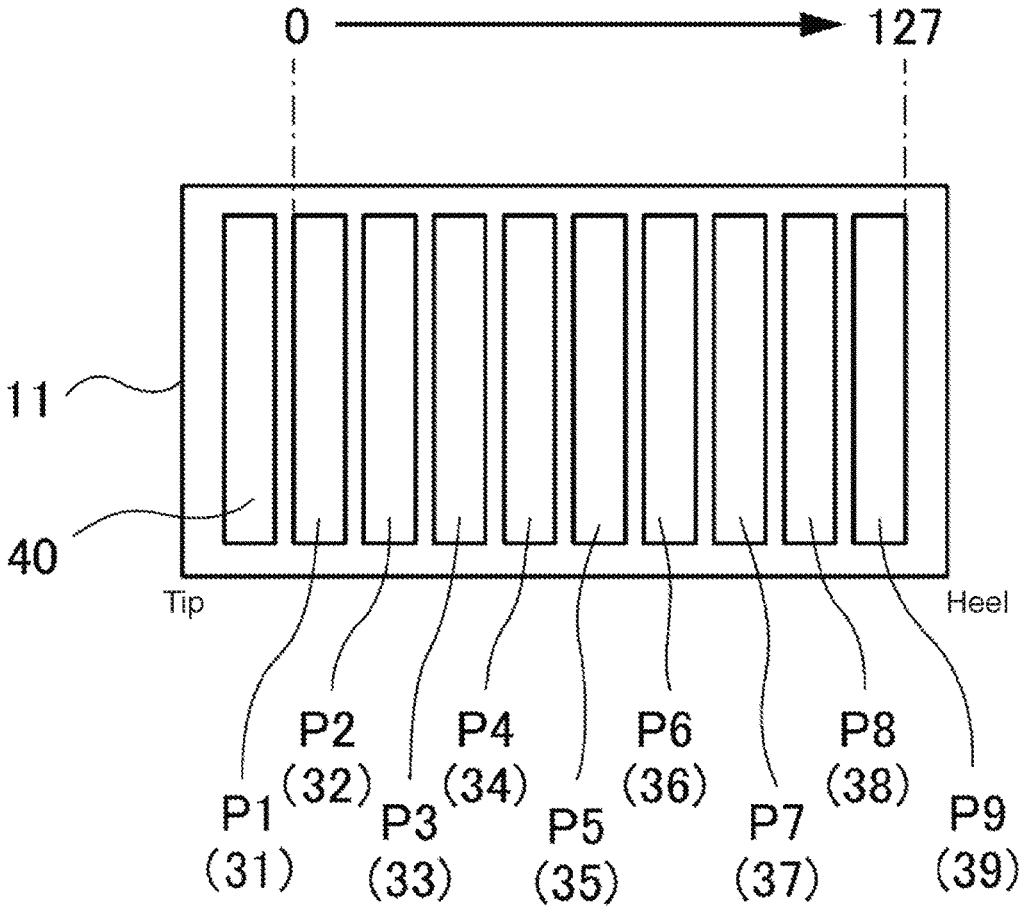
FIG. 6 is a schematic view of sensors included in a reed according to one embodiment of the present invention.

FIG. 6 is a schematic illustration of the sensor electrodes 40 and 31-39 contained in the reed.

In FIG. 6, the positions of the sensor electrodes 31-39 are represented as P1-P9 from the sensor electrode 31 side and a number from "1" to "9" is assigned to each position, to facilitate understanding of the description below.

The contact position (center of gravity XG) of the lip L on the reed 11 can be calculated by the following formula using the output values mi of the touch sensors S21-29 and the position numbers xi (xi=1-9) of the sensor electrodes 31-39.

$$x_G = \frac{\sum_{i=1}^{n} m_i x_i}{\sum_{i=1}^{P1} m_i} \quad \text{<Formula 1>}$$

Here, n is the number of touch sensors. This formula is generally used for calculating center of gravity.

When the output values of the touch sensors S21-S29 corresponding to positions "P1" to "P9" are {0, 0, 0, 0, 90, 120, 150, 120, 90}, for example, the center of gravity XG of the lip L is calculated by:

$$x_G = \frac{5\times 90 + 6\times 120 + 7\times 150 + 8\times 120 + 9\times 90}{90 + 120 + 150 + 120 + 90} = 7.0 \quad \text{<Formula 2>}$$

In one embodiment of the present invention, the center of gravity of the lip L is represented as an integer value (7-bit binary number) from "0" at the tip side "P1" to "127" at the heel side "P9." Specifically, the center of gravity of the lip L is represented as an integer value that is obtained by the CPU 5 taking a number that is 1 subtracted from the center of gravity XG value calculated by the above formula (which is 6.0 in the above example) and dividing this number by the total number of lip sensors, i.e., 9, and then multiplying the result by 127 (rounded down to the nearest decimal point).

Embodiment 1

In view of the above, a reed for an electronic musical instrument (reed 11) according to Embodiment 1, in particular, a touch sensor as the lip sensor 3 is described in detail below.

In regard to the performance required of a touch sensor for detecting the lip L, it is important that, (a) if the lip L moves over the reed 11, the sum total of the sensor values (also referred to as output values) remains constant when the area of contact with the reed 11 is constant, and (b) the effect of noise is small when determining the center of gravity XG of the lip L.

As described below, it was discovered that a substantially V-shaped outline is the optimum outline for the sensor electrode part of a touch sensor satisfying these conditions.

(The Sum Total of Respective Output Values from the Plurality of Touch Sensor is Constant)

A case will be considered in which the lip L moves over the reed 11 from the tip side to the heel side while maintaining a constant contact area.

If the sum total of output values from the touch sensors changes greatly depending on the position of the lip L even though the lip L is moving over the reed 11 from the tip side to the heel side while maintaining a constant contact area as described above, additional control of the sound (pitch, volume, etc.) is required to compensate for this variation, which makes control difficult and causes the control system to become complicated.

On the other hand, if the sum total of output values from the touch sensor is substantially the same regardless of the position of the lip L on the reed 11 while the lip L is moving over the reed 11 from the tip side to the heel side while maintaining a constant contact area, the type of complex control described above is not necessary.

Accordingly, in the case (a) where the lip L is in contact with the reed 11 over a constant area, the maintaining of a constant sum total of sensor values can be considered one of the important factors required of the reed 11.

With this idea in mind, the present inventors investigated the sensor electrodes 110-150 shown in FIGS. 7A-7E.

The term sensor electrodes 110-150 is used to collectively refer to individual sensor electrodes.

In FIGS. 7A-7E, only the parts corresponding to those of sensor electrodes 31-39 shown above in FIG. 6 are shown, and lines showing the outline of the reed 11 and illustration of the sensor electrode 40 are omitted.

First, the shape and so forth of the investigated sensors electrodes 110-150 in FIGS. 7A-7E are described.

Figure 7A:
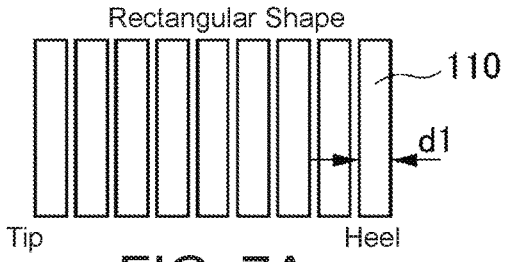
FIGS. 7A to 7E show sensors that were investigated to decide the shape of a sensor according to one embodiment of the present invention.
Figure 7B:
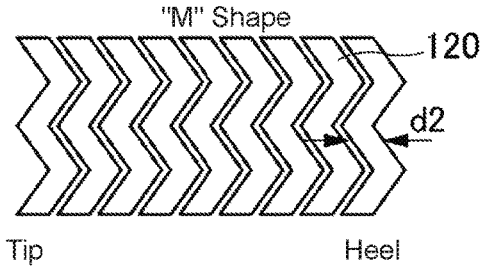
Figure 7C:
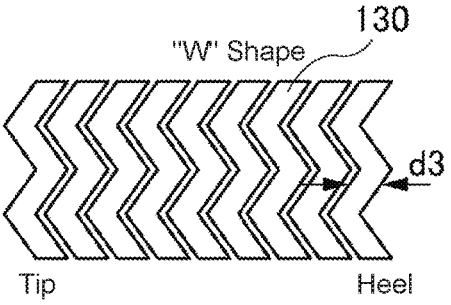
Figure 7D:
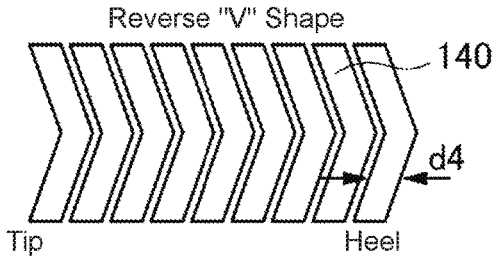
Figure 7E:
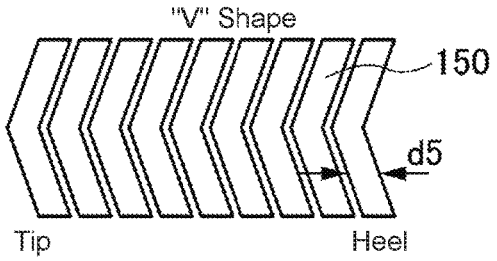

FIGS. 7A-7E show the outlines of the sensor electrodes 110-150; the sensor electrodes 110 in FIG. 7A are rectangular, the sensor electrodes 120 in FIG. 7B are M-shaped, the sensor electrodes 130 in FIG. 7C are W-shaped, the sensor electrodes 140 in FIG. 7D are inverted V-shaped, and the sensor electrodes 150 in FIG. 7E are V-shaped.

In the sensor electrodes 110-150 shown in FIGS. 7A-7E, the width d1-d5 (distance between the sides of the reed 11 along the length thereof) of each of the sensor electrodes 110-150 is equal.

The terms M-shaped, W-shaped, V-shaped and inverted V-shaped derive from the outlines of the sensor electrodes when viewed with the tip side at the bottom and the heel side at the top.

This investigation investigated a case where the lip L is not protruding from the edge of the tip side or the heel side, as in the case where the lip L is positioned near the center of the reed 11 along the length thereof, and thus a case where the sum total of output values from the touch sensors can be properly calculated.

Accordingly, the case where the sum total of output values from the touch sensors would not be properly calculated, as in the case where the lip L is positioned on the sensor electrode at the tip-most side or heel-most side and protrudes from the sensor electrode, is not investigated here.

Figure 8:
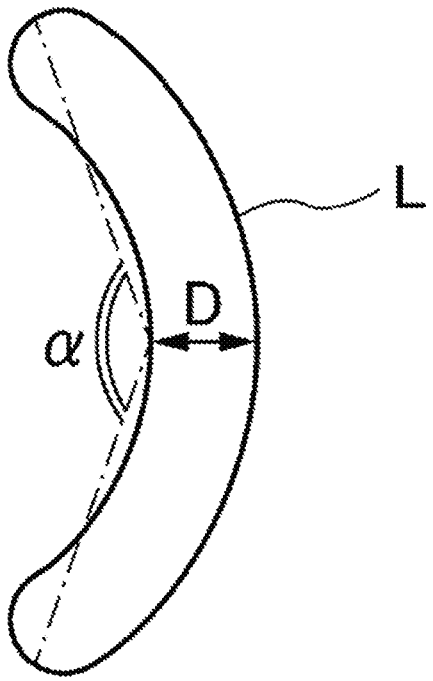
FIG. 8 is a schematic view of a lip touching a reed of one embodiment of the present invention.

The shape of the lip L in contact with the reed 11 is substantially V-shaped or substantially arc-shaped, as shown in FIG. 8.

In addition, because the angle α between the lines connecting the ends to the center (curved part or tip side) of the lip L in contact with the reed 11 was found in a survey to be roughly 130 degrees, albeit with individual differences, and the width D of the lip L in contact with the reed 11 was roughly 7 mm, these values were assumed in the investigations presented below.

When, based on these assumptions, changes were investigated in the sum total of the contact area (also referred to as total contact area) of the lip L on the sensor electrodes 110-150 as the lip L moved over the reed 11 from the tip side to the heel side, a relatively small change was found in the total contact area of the lip L on the rectangular and V-shaped sensor electrodes 110 and 150.

Since the sum total of output values is the sum of all values outputted from the parts of the sensors being touched, there is a corresponding relationship between changes in the sum total of output values and changes in the total contact area, and therefore, the total contact area was compared.

Specifically, the consistency of the total contact area of the lip L as the lip L moved was investigated by obtaining the sum total of the contact area (total contact area) of the lip L in contact with sensors at each position when the lip L was moved at a constant pitch, and calculating the standard deviation of this total contact area.

Since the standard deviation is an indicator of variation from the median, a small standard deviation means that the total contact area was close to the median and had low variation at all positions.

The standard deviations obtained in this way for the rectangular, V-shaped, M-shaped, W-shaped and inverted V shaped sensor electrodes 110-150 were 4.6, 11.2, 67.9, 77.5 and 117.5, respectively.

Accordingly, from the perspective of consistency of the contact area of the lip L (total contact area) as the lip L moves, the sensor electrode 110 (rectangular) had the best consistency, followed by the sensor electrode 150 (V-shaped), and the rectangular sensor electrode 110 and V-shaped sensor electrode 150 can thus be considered good, with fairly low standard deviations.

(Influence of Noise is Small when Determining the Center of Gravity XG of the Lip L)

As explained above, the center of gravity XG of the lip L is calculated using the formula shown in Formula 1.

The extent of error arising in calculating the center of gravity XG differs greatly depending on whether the number of responding sensors is large or small.

Specifically, since a small number of responding sensors is equivalent to a small number of data items for use in calculating center of gravity, when a small number of sensors are responding, a large error can easily arise in the calculation of the center of gravity XG when noise is added.

Conversely, since a large number of responding sensors is equivalent to a large number of data items for use in calculating center of gravity, when a large number of sensors are responding, the effect of any added noise will be relatively small, and errors arising in the calculation of the center of gravity XG due to the effects of noise will be small.

Accordingly, in order to inhibit the effect of noise on the center of gravity calculation, it is preferable for the layout of sensors to be such that multiple sensors can be in contact with and respond to the lip L no matter where the lip L is positioned.

Focusing on a single sensor, this means that when the lip L passes over the sensor by moving over the reed 11 from the tip-side edge to the heel-side edge, this single sensor remains in contact with the lip L for a long period.

This is because a layout that allows multiple sensors to be in contact with the lip L is equivalent to contact with the lip L on a single sensor (or change in capacitance in the sensor due to approach of the lip L) persisting when the lip L moves over the reed 11, and in such cases the contact area of the lip L on this sensor will change slowly over a long period.

Accordingly, a good sensor electrode is such that, when the lip L moves over the reed 11 from the tip-side edge to the heel-side edge, the sensor output values changes gently in response to movement of the lip L and continues to be outputted for as long as possible.

Figure 9:
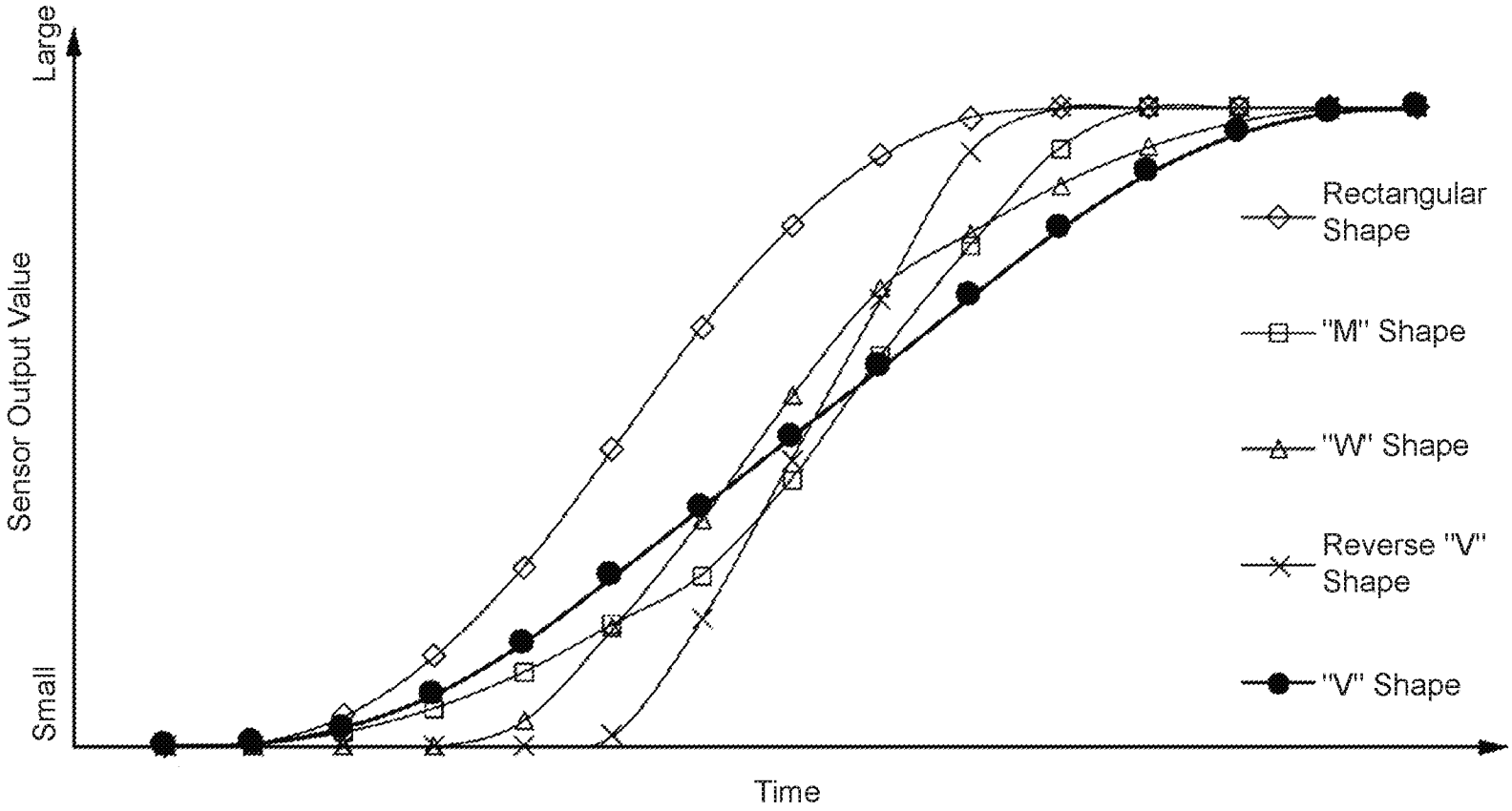
FIG. 9 is a graph showing how the contact area between sensor and lip varies as the lip moves over sensors shaped as shown in FIGS. 7A to 7E.

FIG. 9 is a graph showing how the contact area between the sensor electrode and lip L varies as the lip L moves, focusing on particular one of the sensor electrodes (e.g., the fifth sensor positioned in the middle of the reed 11) having various shapes shown in FIGS. 7A to 7E.

FIG. 9 shows changes from when the lip L is not in contact to when maximum contact is made, but does not show the portion of decreasing contact area as the lip L passes.

In FIG. 9, the horizontal axis shows time (in particular, time as the lip L is being moved from the tip side to the heel side and the output value of the sensor changes from 0 to the maximum value), and the vertical axis shows the contact area between the lip L and the sensor (the output value of the corresponding sensor).

Figure 10A:
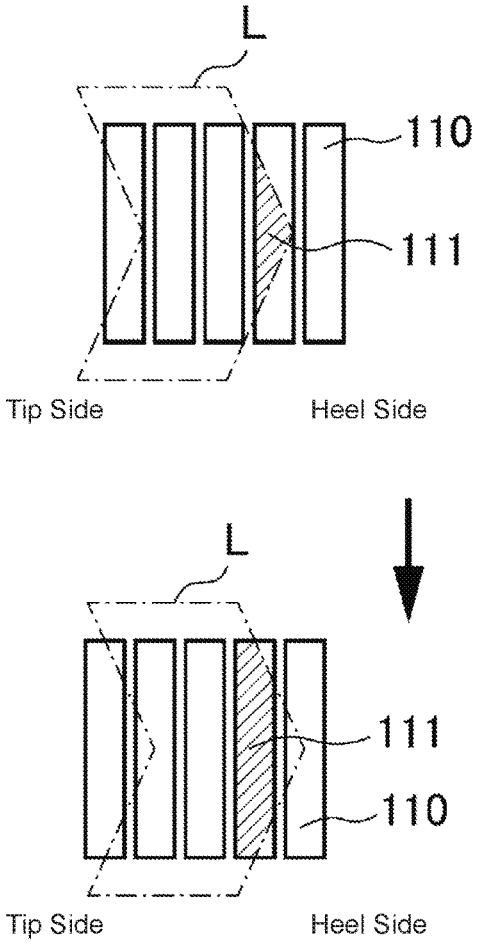
FIGS. 10A and 10B are schematic views of a lip as it moves over sensors.
Figure 10B:
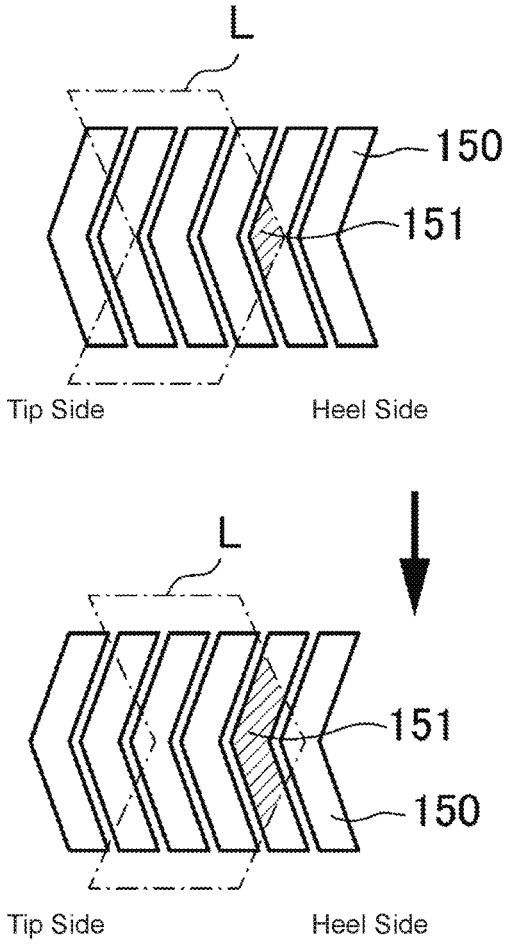

Here, a supplemental explanation to the FIG. 9 graph is provided with reference to FIGS. 10A and 10B to facilitate understanding of the FIG. 9 graph.

FIGS. 10A and 10B are schematic views of the lip L as the lip L moves over the sensor electrodes; FIG. 10A shows the case for the rectangular sensor electrode 110, and FIG. 10B shows the case for the V-shaped sensor electrode 150. At the top side of FIG. 10A, there are four sensors outputting output values, and at the bottom side of FIG. 10B, there are five sensors outputting output values. At the top side of FIG. 10B, there are five sensors outputting output values, and at the bottom side of FIG. 10B, there are five sensors outputting output values. In other words, there are cases in which the total number of sensors outputting output values is higher for the V-shaped sensors in FIG. 10B than for the rectangular shaped sensors in FIG. 10A, which can be said makes it possible to stably detect the center of gravity of the lip L.

FIGS. 10A and 10B focus on, with respect to the rectangular sensor electrodes 110, the amount of change in the contact area of the fourth sensor from the tip side, and with respect to the V-shaped sensor electrodes 150, the amount of change in the contact area of the fifth sensor from the tip side. The lip L shown at the top of FIGS. 10A and 10B moves from the tip side to the heel side shown in the bottom drawing, as indicated by hatching (see hatching 111 for the rectangular sensor electrode 110 and hatching 151 for the V-shaped sensor electrode 150).

In the FIG. 9 graph, the starting point of change in contact area is the tip-most side, the end point when the contact area reaches a maximum is the heel-most side, and a gentle slope of contact area from starting point to end point indicates a good sensor capable of contact with the lip L for a long period when the lip L is moving.

FIG. 9 shows that the V-shaped sensor electrode is favorable, since the rectangular, M-shaped, W-shaped and inverted V-shaped sensor electrodes have more pronounced slopes of increasing contact area, with a shorter distance from the starting point to the end point.

Also, from the perspective of the consistency of the contact area (total contact area) of the lip L as the lip L moves, which was evaluated above, the V-shaped sensor electrode 150 has a slightly greater standard deviation than the rectangular sensor electrode 110, but considering that the standard deviation is rather small, the V-shaped sensor electrode 150 can be considered superior overall.

(Optimum Angle of V-shaped Sensor)

The V shape of the V-shaped sensor electrode has preferable degrees of opening, which are described below.

Figure 11:
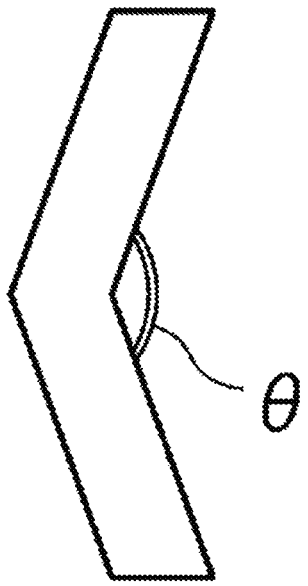
FIG. 11 illustrates the angle of a V-shaped sensor according to one embodiment of the present invention.

In FIG. 11, which illustrates the angle of the V-shaped sensor electrode, the open angle θ on the inside of the V shape is defined as the sensor angle.

A preferred range for the sensor angle θ defined in this way is described below.

A small angle θ means that the V shape becomes narrow, which means that a certain depth (length to heel side) is necessary for forming a single V-shaped sensor electrode. However, an excessively small angle θ will result in the reed 11 having a small number of sensors because the entire depth of the reed 11 (length from tip side to heel side) is fixed.

Figure 12A:
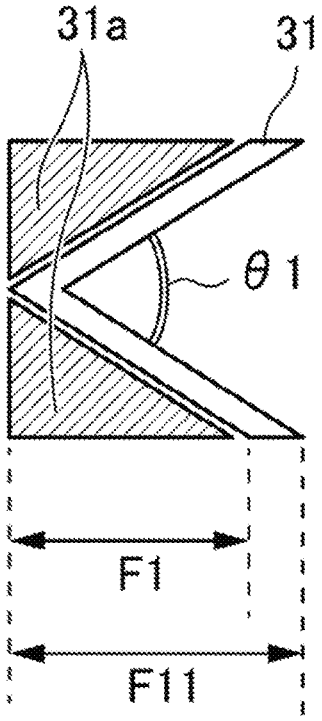
FIGS. 12A and 12B are schematic views of a V-shaped sensor to illustrate the suitable angle of the V-shaped sensor according to one embodiment of the present invention.
Figure 12B:
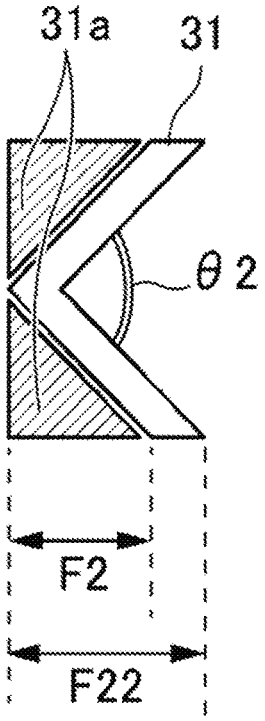

This is explained more specifically with reference to FIGS. 12A and 12B.

FIGS. 12A and 12B are schematic views of the sensor electrode 31 on the tip-most side; FIG. 12A shows the case when the angle θ is a small angle θ1, and FIG. 12B shows the case when the angle θ is a large angle θ2.

As can be seen from FIGS. 12A and 12B, the depth is F11 when the angle θ is a small angle θ1 (see FIG. 12A), and the depth is F22 when the angle θ is a large angle θ2 (see FIG. 12B), and it is clear that more depth is required with the small angle θ1.

When the angle θ is small and the V shape thus becomes narrow, greater depth is required for a single sensor electrode and the number of sensor electrodes in the fixed-size reed 11 becomes small.

In addition, although there is no sensor to the outside of the sensor positioned at the tip-most side (see region 31*a* in FIGS. 12A and 12B), when the V shape is narrow, the depth of this region 31*a* that cannot be occupied by a sensor (length to the heel side) increases, as can be seen by comparing the distance F1 in FIG. 12A with the distance F2 in FIG. 12B.

Therefore, a V-shaped sensor electrode with a small angle θ has the problem that the contact area varies greatly when the lip L is at the tip side.

Conversely, a large angle means that the shape approaches that of a rectangular sensor electrode, and therefore loses the advantages of the V shape.

It was concluded from these considerations that it is preferable for the open angle θ to be 130 degrees to 140 degrees.

Since the output value from each sensor changes if the width of each sensor electrode is changed, it is preferable for the reed 11 to have a plurality of V-shaped sensor electrodes of substantially equal width with an open angle of 130 degrees to 140 degrees, provided on a substrate so that the tip of the V shape faces the tip side (tip side) of the substrate included in the reed 11, and it is further preferable for the sensor electrodes to be arranged in a line at substantially equal intervals from the tip side (tip side) to the heel side (base side) of the reed 11.

As described above, the reed 11 having sensors with this kind of shape (V-shape) is not only unsusceptible to the effects of noise, but also has small variation in total contact area (variation in sum total of output values from each sensor) and excellent controllability when the lip L moves from the tip side to the heel side.

Embodiment 2

Next, a reed 11B according to Embodiment 2 of the present invention will be described with reference to FIG. 13.

Figure 13:
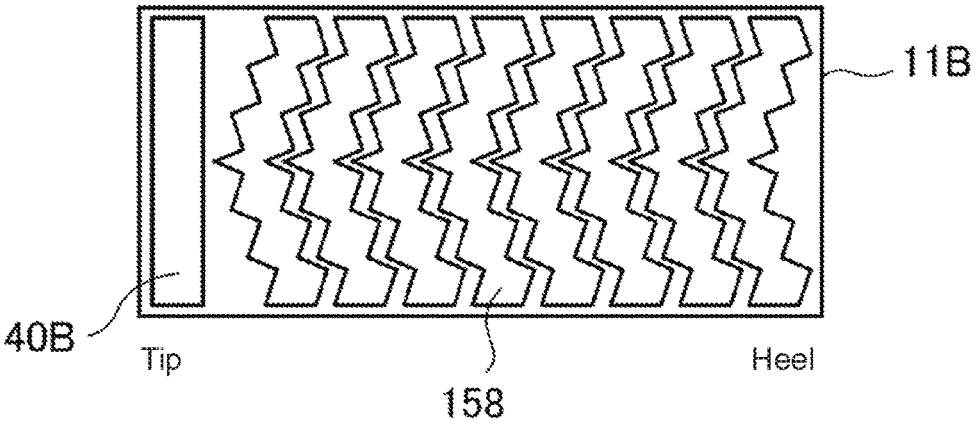
FIG. 13 shows sensors included in a reed according to Embodiment 2 of the present invention.

FIG. 13 shows sensor electrodes 158 included in the reed 11B.

The sensor electrodes 158 according to Embodiment 2 have the same basic shape as that of Embodiment 1, having a V-shaped outline with an inside open angle not less than 130 degrees and not more than 140 degrees.

However, unlike in Embodiment 1, a series of triangular indentations is present on the tip side and heel side of the V shape.

With the sensor 158 of Embodiment 2 shaped in this way, there are cases where the indentations can touch the lip L even though the lip L cannot touch the parts of the basic V shape due to the shape of the lip L or the way in which the reed 11B is held in the mouth of the performer P (when held in the mouth at an angle, for example), and contact with the lip L can be made more easily than when using a simple V shape.

Embodiment 2 is therefore preferable in having a higher probability of the lip L being able to touch the sensors than in Embodiment 1.

Various embodiments for a reed for an electronic musical instrument and an electronic musical instrument according to the present invention were described above, but the present invention is not limited to these concrete embodiments.

Figure 14:
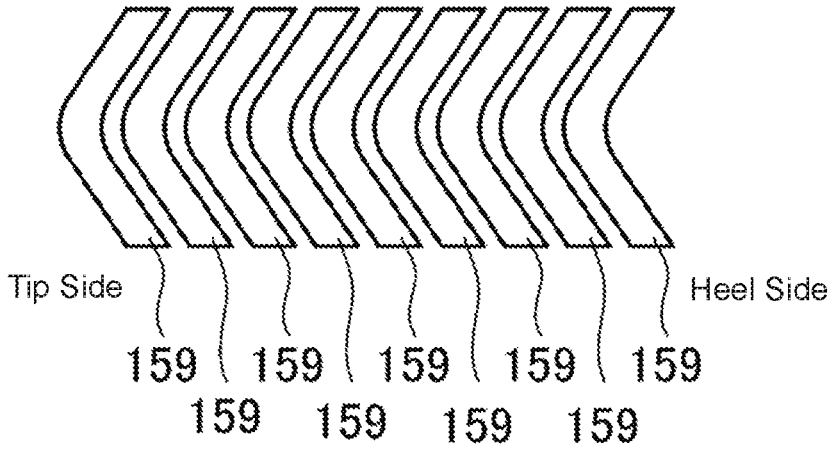
FIG. 14 shows a first variation of the shape of sensors included in a reed according to one embodiment of the present invention.

In Embodiment 1, the sensor electrodes 31-39 are shaped so that the tips of the V shapes are pointed, but the tips of the V shapes do not need to be pointed and can be rounded, as in sensor electrodes 159, as shown in FIG. 14, which is a first modification example.

In addition, the overall shape can be a U shape.

Figure 15:
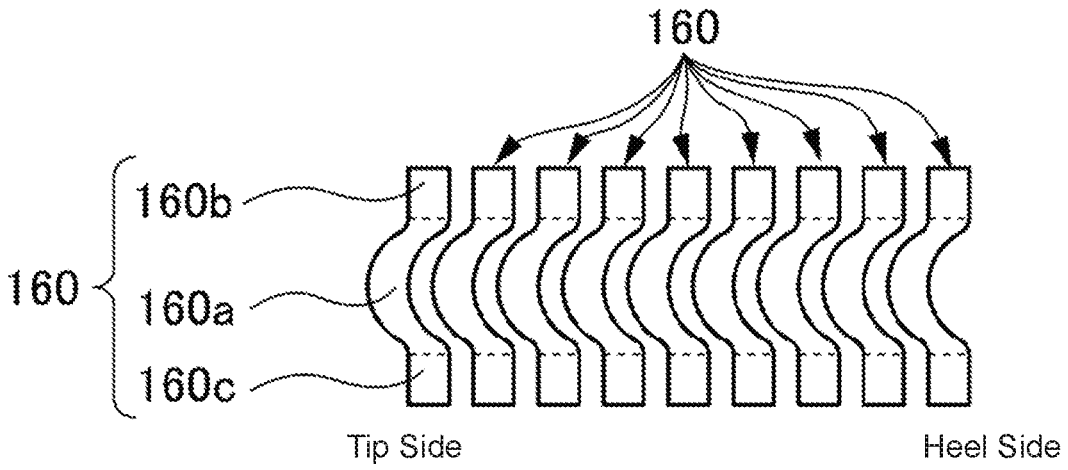
FIG. 15 shows a second variation of the shape of sensors included in a reed according to one embodiment of the present invention.

Furthermore, the whole sensor electrode need not be V-shaped or U-shaped. As shown in sensor electrodes 160 of FIG. 15, which is a second modification example, the center part 160*a* as viewed from a direction perpendicular to the lengthwise direction of the reed 11 (reed 11 substrate) can have a V shape or U shape, for example, projecting at least towards the distal (tip) side of the reed 11 (reed 11 substrate), while both side parts external to the center part 160*a* (a side part 160*b* on one side and a side part 160*c* on another side) can be rectangular (square, for example), extending in a direction intersecting (substantially perpendicular to) the lengthwise direction of the reed 11.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A reed for an electronic musical instrument, comprising:

a substrate having a tip side and a base side; and a plurality of sensor electrodes on the substrate, arranged next to one another from the tip side towards the base side, each of the plurality of sensor electrodes having a center part projecting towards the tip side of the substrate.

2. The reed for the electronic musical instrument according to claim 1, wherein the center part of each of the sensor electrodes projects the most towards the tip side of the reed than any other part of the sensor electrode.

3. The reed for the electronic musical instrument according to claim 1, wherein, in each of the sensor electrodes, no part of the sensor electrode except the center part projects towards the tip side of the substrate.

4. The reed for the electronic musical instrument according to claim 1, wherein the sensor electrodes are of substantially equal width and are arranged next to one another at substantially equal intervals from the tip side of the reed towards the base side.

5. The reed for the electronic musical instrument according to claim 1, wherein the sensor electrodes each have a substantially V-shape, and are arranged on the substrate such that a bottom of the substantially V-shape faces the tip side of the reed.

6. The reed for the electronic musical instrument according to claim 5, wherein an inner open angle of the substantially V-shape of each of the sensor electrodes is from 130 degrees to 140 degrees.

7. The reed for the electronic musical instrument according to claim 5, wherein each sensor electrode is shaped to have a series of triangular indentations along sides of the substantially V-shape.

8. An electronic musical instrument comprising:

a substrate having a tip side and a base side;

a plurality of sensors on the substrate, arranged next to one another from the tip side towards the base side, the plurality of sensors respectively having sensor electrodes, each of the sensor electrodes having a center part projecting towards the tip side of the substrate;

at least one or more operating units to receive operations by a performer; and a processor configured to execute the following:

a determination process of determining a lip position of the performer in accordance with output from the plurality of sensors; and a control process causing the electronic musical instrument to emit a musical sound that corresponds to the lip position determined by the determination process and an operation of the at least one or more operating units.

9. The electronic musical instrument according to claim 8, wherein the sensor substrate is a reed on which the plurality of sensors are provided.

10. The electronic musical instrument according to claim 8, wherein the center part of each of the plurality of sensors projects the most towards the tip side of the substrate than any other part of the sensor.

11. The electronic musical instrument according to claim 8, wherein, in each of the sensors, no part of the sensor electrode except the center part projects towards the tip side of the substrate.

12. The electronic musical instrument according to claim 8, wherein the sensor electrodes are of substantially equal width and are arranged next to one another at substantially equal intervals from the tip side of the substrate towards the base side.

13. The electronic musical instrument according to claim 8, wherein the plurality of sensor electrodes each have a substantially V-shape, and are arranged on the substrate such that a bottom of the substantially V-shape faces the tip side of the substrate.

14. The electronic musical instrument according to claim 13, wherein an inner open angle of the substantially V-shape of each of the sensor electrodes is from 130 degrees to 140 degrees.

15. The electronic musical instrument according to claim 13, wherein each sensor electrode is shaped to have a series of triangular indentations along sides of the substantially V-shape.

* * * * *